US005243910A

United States Patent [19]

Burch

[11] Patent Number: 5,243,910

[45] Date of Patent: Sep. 14, 1993

[54] WASH ASSEMBLY FOR INK TRAIN

[75] Inventor: Laymon L. Burch, Glendale, Ariz.

[73] Assignee: B. Bunch Company, Inc., Phoenix, Ariz.

[21] Appl. No.: 866,982

[22] Filed: Apr. 10, 1992

Related U.S. Application Data

[63] Continuation-in-part of Ser. No. 719,988, Jun. 24, 1991, Pat. No. 5,140,900.

[51] Int. Cl.[5] ..... B41F 35/04

[52] U.S. Cl. ..... 101/425; 101/424; 15/256.52

[58] Field of Search ..... 101/425, 429, 423; 15/256.52, 256.51

[56] References Cited

U.S. PATENT DOCUMENTS 3,084,626 4/1963 Stobb ..... 101/425
3,467,011 9/1969 Phleps et al. ..... 101/425
3,701,316 10/1972 Sylvester et al. ..... 101/425
3,792,925 2/1974 Milligan et al. ..... 15/256.52
5,069,128 12/1991 Hara et al. ..... 101/425

FOREIGN PATENT DOCUMENTS 2284455 8/1975 France ..... 101/425

*Primary Examiner*—Edgar S. Burr
*Assistant Examiner*—Anthony H. Nguyen
*Attorney, Agent, or Firm*—Tod R. Nissle

[57] ABSTRACT

Cleaning apparatus for removing the ink distribution assembly of a printing machine. The ink distribution assembly includes a plurality of rollers which transfer ink from one to the other. The cleaning apparatus includes a portable frame, a cleaning roller mounted on the frame, and attachment means for mounting the cleaning apparatus on the ink distribution assembly such that the cleaning roller is pressed against a roller in the ink distribution assembly under the force of gravity.

6 Claims, 3 Drawing Sheets

WASH ASSEMBLY FOR INK TRAIN

This is a continuation-in-part of patent application Ser. No. 719,988, filed Jun. 24, 1991, for "INK DISTRIBUTION ASSEMBLY", now U.S. Pat. No. 5,140,900, issued Aug. 25, 1992.

This invention relates to apparatus for washing and cleaning the ink distribution assembly in a printing apparatus, the ink distribution assembly comprising a series of rollers which transfer ink from one to the other.

More particularly, the invention relates to lightweight, portable, cleaning apparatus which includes a cleaning roller, and which is readily mounted on the ink distribution assembly to press under the force of gravity the cleaning roller against a selected one of the rollers comprising the ink distribution assembly.

In a further respect, the invention relates to cleaning apparatus of the type described which rotates the cleaning roller at a lower RPM to clean all of the rollers in the ink distribution assembly.

The ink train assembly in a printing machine comprises a fountain roller, a fountain for supplying ink to the fountain roller, a distributor roller, a ductor roller for transferring ink from the fountain roller to the distributor roller, and at least one downstream roller which contacts and receives ink from the distributor roller. If there is more than one downstream roller, then, typically, the first downstream roller contacts and receives ink from the distributor roller, the second downstream roller contacts and receives ink from the first downstream roller, the third downstream roller contacts and receives ink from the second downstream roller, etc. However, as is well known, two or more downstream rollers can contact and receive ink from the distributor roller or from some other downstream rollers. Further, one of the downstream rollers is normally an oscillating roller which moves back and forth in directions parallel to the longitudinal axis of the oscillating downstream roller.

Cleaning the ink train or ink distribution assembly of a printing machine is a time consuming project which is usually accomplished by placing a nylon or rubber blade against one of the rollers in the ink train assembly to scrape ink from the roller into a collection tray positioned beneath the roller. This procedure is messy and does not always insure that all of the ink has been removed from the roller. Further, once the ink is scraped from the roller, the rubber blade and collection tray must be cleaned to remove the ink scrapped from the roller.

Accordingly, it would be highly desirable to provide an improved ink train cleaning apparatus which could be readily mounted on the ink train assembly, which would insure that all of the rollers in the ink train assembly were clean, and which would permit ready disposal of the removed ink without requiring that the ink train cleaning apparatus be cleaned.

Therefore, it is a principal object of the invention to provide improved apparatus for cleaning the ink train assembly of a printing machine.

A further object of the invention is to provide an improved ink train cleaning apparatus which can be readily mounted at one selected location on an ink train assembly to clean all of the rollers in the ink train assembly.

Another object of the invention is to provide an improved ink train cleaning apparatus which does not, after the apparatus is used to remove ink from the rollers in an ink train assembly, require cleaning.

Still a further object of the instant invention is to provide an improved ink train cleaning apparatus in which the force of gravity determines the pressure applied by the cleaning apparatus to a roller in an ink train assembly during the removal of ink from the ink train assembly.

These and other, further and more specific objects and advantages of the invention will be apparent to those skilled in the art from the following detailed description thereof, taken in conjunction with the drawings, in which.

Figure 1:
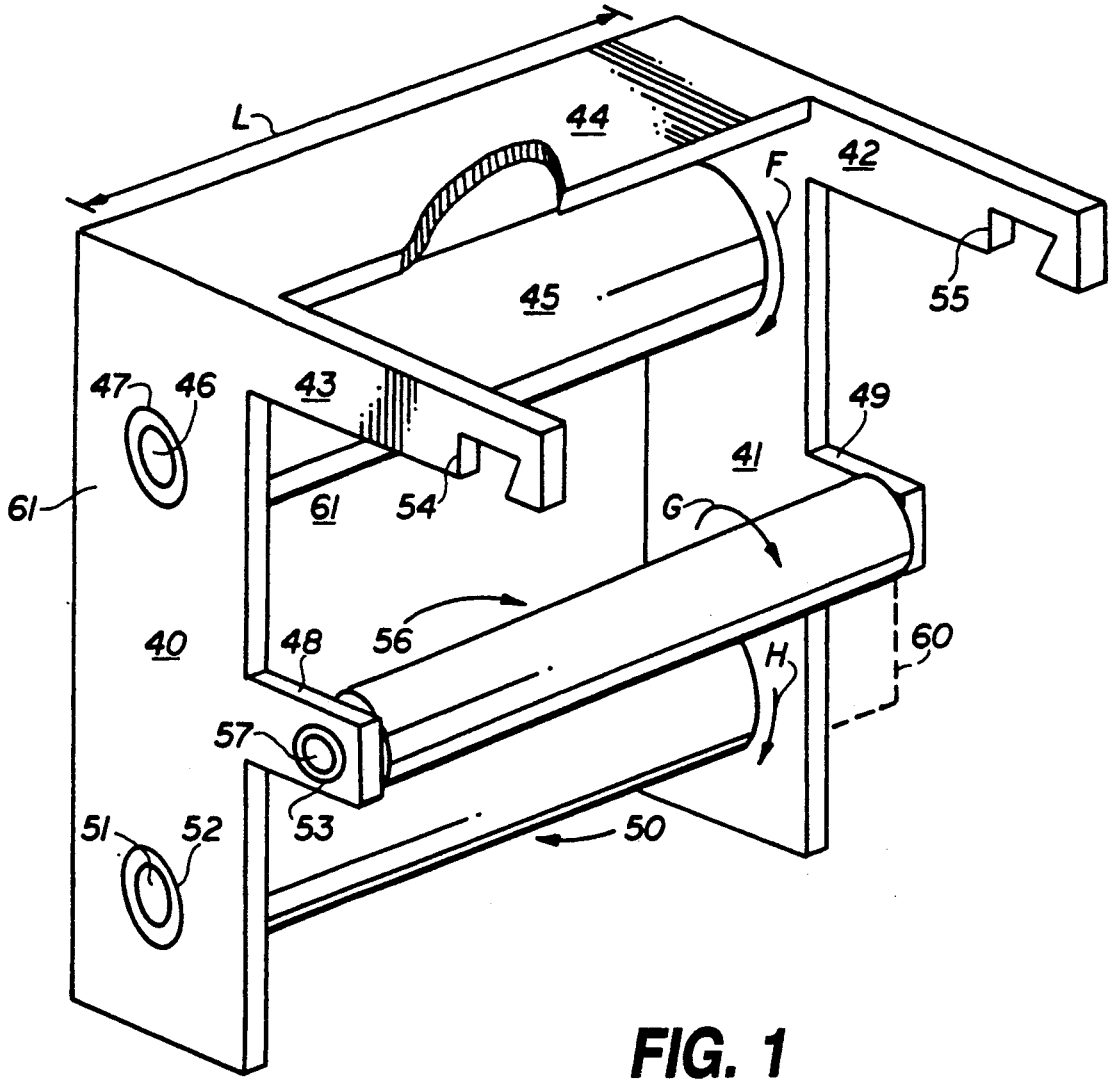
FIG. 1 is a perspective view illustrating cleaning apparatus constructed in accordance with the principles of the invention.

Briefly, in accordance with my invention, I provide an improvement used in combination with an ink distribution assembly in a printing apparatus. The ink distribution assembly includes frame means; a fountain roller mounted on the frame means; fountain means mounted on the frame means for storing a quantity of ink and distributing the ink on the fountain roller; a distributor roller mounted on the frame means and generally parallel to and at a fixed distance from the fountain roller; a ductor roller mounted on the frame means and generally parallel to the fountain roller for transferring ink from the fountain roller to the distributor roller; at least one downstream roller mounted on the frame means and parallel to and operatively associated with the distributor roller to carry ink from the distributor roller to a selected roller station in the printing apparatus; and, motive power means for causing the fountain roller, the ductor roller, the distributor roller and the downstream roller to rotate such that ink travels sequentially from the fountain means to the fountain roller, ductor roller, distributor roller, and downstream roller. The improvement comprises means for cleaning the ink distribution assembly. The cleaning means comprises a portable frame; a cleaning roller mounted on the frame; an attachment mechanism for pivotally mounting the frame on the frame means of the ink distribution assembly such that the force of gravity acting on the portable frame causes the portable frame to pivot with respect to the frame means and press the cleaning roller against a selected one of the rollers in the group consisting of the fountain roller, ductor roller, distributor roller, and downstream roller; and, means mounted on the frame for, when the attachment mechanism is used to mount the portable frame on the frame means to press the cleaning roller against the selected one of the rollers of the ink distribution assembly, drawing a strip of material over the cleaning roller intermediate the cleaning roller and the selected one of the rollers of the ink distribution assembly.

In another embodiment of my invention, I provide an improvement used in combination with an ink distribution assembly in a printing apparatus. The ink distribution assembly includes frame means; a fountain roller mounted on the frame means; fountain means mounted on the frame means for storing a quantity of ink and distributing the ink on the fountain roller; a distributor roller mounted on the frame means and generally parallel to and at a fixed distance from the fountain roller; a ductor roller mounted on the frame means and generally parallel to the fountain roller for transferring ink from the fountain roller to the distributor roller; at last one downstream roller mounted on the frame means and parallel to and operatively associated with the distributor roller to carry ink from the distributor roller to a selected roller station in the printing apparatus; and, motive power means for causing the fountain roller, the ductor roller, the distributor roller and the downstream roller to rotate such that ink travels sequentially from the fountain means to the fountain roller, ductor roller, distributor roller, and downstream roller. The improvement comprises means for cleaning the ink distribution assembly. The cleaning means comprises a frame; a cleaning roller mounted on the frame; and, an attachment mechanism for pivotally mounting the frame on the frame means of the ink distribution assembly such that the force of gravity acting on the frame causes the cleaning roller to press against a selected one of the rollers in the group consisting of the fountain roller, ductor roller, distributor roller, and downstream roller.

In still another embodiment of my invention, I provide an improvement used in combination with an ink distribution assembly in a printing apparatus. The ink distribution assembly includes frame means; a fountain roller mounted on the frame means; fountain means mounted on the frame means for storing a quantity of ink and distributing the ink on the fountain roller; a distributor roller mounted on the frame means and generally parallel to and at a fixed distance from the fountain roller; a ductor roller mounted on the frame means and generally parallel to the fountain roller for transferring ink from the fountain roller to the distributor roller; at last one downstream roller mounted on the frame means and parallel to and operatively associated with the distributor roller to carry ink from the distributor roller to a selected roller station in the printing apparatus; and, motive power means for causing the fountain roller, the ductor roller, the distributor roller and the downstream roller to rotate such that ink travels sequentially from the fountain means to the fountain roller, ductor roller, distributor roller, and downstream roller. The improvement comprises means for cleaning the ink distribution assembly. The cleaning means comprises a frame; a cleaning roller mounted on the frame; an attachment mechanism for mounting the frame on the frame means of the ink distribution assembly such that the cleaning roller presses against a selected one of the rollers in the group consisting of the fountain roller, ductor roller, distributor roller, and downstream roller; and, means mounted on the frame for, when the attachment mechanism is used to mount the portable frame on the frame means to press the cleaning roller against the selected one of the rollers of the ink distribution assembly, drawing a strip of material over the cleaning roller intermediate the cleaning roller and the selected one of the rollers of the ink distribution assembly.

Turning now to the drawings, which depict the presently preferred embodiment of the invention for the purpose of describing the practice thereof and not by way of limitation of the scope of the invention, and in which like characters refer to corresponding elements throughout the several views, FIG. 1 illustrates cleaning apparatus constructed in accordance with the principles of the invention and including a frame having side panels 40 and 41, back panel 61 connected to and spanning the distance between panels 40 and 41, top panel 44 connected to and spanning the distance between panels 40 and 41, parallel arms 42 and 43 connected to and extending outwardly from panels 40 and 41, respectively, and parallel arms 48 and 49 connected and extending outwardly from panels 40 and 41, respectively. Roller 45 is fixedly attached to and carried on axle 46. Axle 46 extends along the longitudinal axis of and completely through roller 45. The outer ends of axle 46 each extend outwardly away from roller 45 and are journalled for rotation in a pair of bushings 47 each mounted in one of walls 40 and 41. Take up roller 50 is fixedly attached to and carried on axle 51. Axle 51 extends along the longitudinal axis of and completely through roller 50. The outer ends of axle 51 each extend outwardly away from roller 50 and are journalled for rotation in two bushings 52. Each bushing 52 is mounted in one of walls 40 and 41. Roller 56 is fixedly attached to and carried on axle 57. Axle 57 extends along the longitudinal axis of and completely through roller 56. The outer ends of axle 57 each extend outwardly away from roller 56 and are journalled for rotation in a pair of bushings 53 each mounted in one of arms 48 and 49. U-shaped slots 54 and 55 are each formed in the distal end of arms 43 and 42, respectively. Roller 50 is rotated in the direction of arrow H by a motor 60 or some other desired motive power means. Roller 50 can, if desired, be cranked by hand.

Although not shown in FIG. 1, a strip 57 (FIG. 2) of cotton, styrofoam, or some other ink absorbent material is wound on roller 45 and extends from roller 45 over roller 56 and onto the take up roller 50. When motor 60 turns roller 50 in the direction of arrow H, strip 57 is pulled over roller 56 and onto take up roller 50. Roller 56 and axle 57 freewheel in bushings 53. Consequently, when strip 57 is pulled over roller 56, roller 56 turns in the direction indicated by arrow G in FIG. 1. When strip 57 is pulled from roller 45 onto take up roller 50, axle 46 turns in bushings 47 and roller 45 rotates in the direction of arrow F in FIG. 1. In FIG. 1, arrows L indicate the length of each roller 45, 56, 50.

Figure 2:
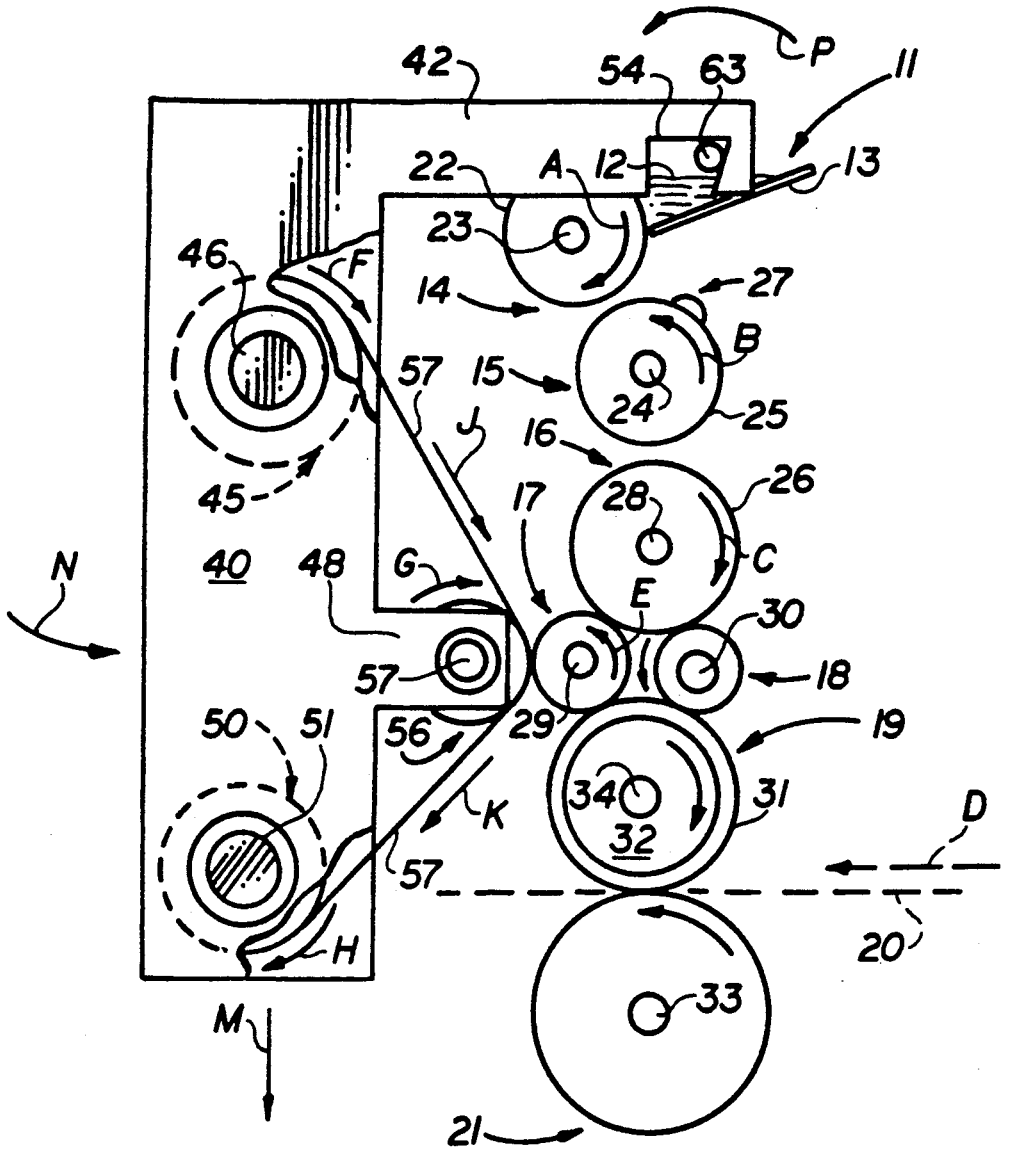
FIG. 2 is a side view illustrating the cleaning apparatus of FIG. 1 mounted on an the ink distribution assembly; and, FIG. 3 is a side view illustrating an alternate embodiment of the invention.

In FIG. 2, the cleaning apparatus of FIG. 1 is shown mounted on an ink distribution assembly. The ink distribution assembly includes fountain means 11, fountain roller 14, ductor roller 15, distributor roller 16, form rollers 17 and 18, plate or imprinting roller 19, and support roller 21. The length of each roller 14 to 19, 21 is presently preferably equal to or less than the length L of roller 56, but can, if desired, be greater than the length L of roller 56. Fountain means 11 includes a plate or blade 13 which supports in part a reservoir 12 of ink. The lower edge of blade 13 is adjacent the smooth outer cylindrical surface of fountain roller 14. Roller 14 draws ink 12 along its surface 22 intermediate the lower edge of blade 13. Roller 14 is fixedly attached to and rotates simultaneously with shaft 23.

Ductor roller 15 is fixedly attached to and simultaneously rotates with shaft 24. The outer cylindrical surface 25 of ductor roller 15 is spaced apart from surface 22 of roller 14 and from the outer smooth cylindrical surface 26 of distributor roller 16. Resilient longitudinal strip 27 extends the length of ductor roller 15 and is parallel to the longitudinal axis of roller 15 and to elongate shaft 24. Strip 27 extends outwardly from surface 25 a distance sufficient for strip 27 to bridge the gap between rollers 14, 15 at their closest approach and for strip 27 to "kiss" surface 22 to remove ink from surface 22 onto strip 27. The distance between rollers 15 and 16 at their point of closest approach is about equal to the distance between rollers 14 and 15 at their closest approach such that strip 27 can bridge the gap between rollers 15, 16 and apply ink to surface 26 of the distributor roller 16. Roller 16 is fixedly attached to and rotates simultaneously with elongate cylindrical shaft 18.

Form rollers 17 and 18 are fixedly attached to and rotate simultaneously with shafts 29 and 30, respectively. Imprinting roller 19 includes plate 19 or other printing means on the circumference of a cylindrical roller 32. Plate 31 typically includes upraised portions which receive ink from the outer smooth cylindrical surfaces of form rollers 17 and 18 and apply the ink to the strip 20 made from paper or other desired materials. Strip 20 of paper or other material is drawn in the direction of arrow D between imprint roller 19 and support roller 21.

Points on the surfaces of form rollers 17 and 18 typically move at the same velocity as points on the outer cylindrical surface of distributor roller 26 and as points on the outer surface of cylindrical plate 31. Points on the outer surface of plate 31 move at about the same velocity as points on the outer smooth cylindrical surface of support roller 21. Support roller 21 is fixedly attached to and rotates simultaneously with elongate cylindrical shaft 33. Imprinting roller 19 is fixedly attached to and rotates simultaneously with elongate cylindrical shaft 34. Elongate cylindrical shafts 23, 24, 28, 29, 30, 33, 34 are parallel to one another, as are rollers 14 to 19, 21.

Plate 21 can be fabricated from metal, rubber, or any other desired material. Rollers 14 and 15 presently are of equal diameter and rotate at the same speed to facilitate construction of the gearing which drives rollers 14 and 15. If desired, the size and speed of rotation of roller 14 can be different than that of roller 15. Rollers 14 and 15 also presently rotate in opposite directions, as indicated by arrows A and B in FIG. 1. If desired, roller 14 can rotate in the same direction as roller 15. The direction of rotation of distributor roller 16 is indicated by arrow C in FIG. 1 and presently is opposed to the direction of rotation of roller 15. The velocity of a point on the surface of distributor roller 26 normally is greater than the velocity of a point on the surface of roller 15. Consequently, when strip 27 contacts surface 26, roller 16 imparts a force to strip 27 and to roller 15 which acts to increase the speed of rotation of roller 15 in the direction of arrow B. When rollers 14 and 15 are driven by a pulley or by a gear train, there normally is no slack in the gear train and the speed of rotation of roller 15 will not increase when strip 27 contacts surface 26 of a distributor roller 16 which has a surface speed greater than the speed of movement of strip 27. In this situation, strip 27 slides over surface 26. However, the drive for rollers 14 and 15 can include a one-way clutch which, when strip 27 contacts the surface 26 of roller 16, permits rollers 14 and 15 to free-wheel and move at a greater than normal speed while strip 27 contacts the surface 26 of roller 16.

In FIG. 2, form rollers 17 and 18 comprise downstream rollers. Downstream rollers receive ink from the distributor roller 16 and carry the ink to a desired roller station. As used herein, downstream rollers can comprise vibrator rollers, form rollers, rider rollers or any other type of roller used in a chain of rollers to transfer ink from the distributor roller 16 to a desired station roller. There can be one or more downstream rollers. There typically are four or more downstream rollers. The station roller is any roller which receives ink from the downstream roller(s). In FIG. 2, the imprinting roller 19 is a station roller.

The distributor roller 16, imprinting roller 19, and support roller 21 presently preferably are driven rollers. Form rollers 17 and 18 can be driven. During the operation of the ink distribution assembly of FIG. 2, shafts 23, 24, 28, 29, 30, 33, 34 maintain the spacings relative to one another which are indicated in FIG. 2, i.e., the shafts do not move in horizontal or vertical directions which lie in the plane of the sheet of paper of the drawing of FIG. 2. As would be appreciated by those of skill in the art, if roller 17 was a vibrator or oscillating roller, roller 17 would move back and forth in directions which are parallel to the longitudinal axis of shaft 29 and perpendicular to the plane of the sheet of paper of the drawing. Further, the ductor roller 15 in FIG. 2 can be replaced by a ductor roller which oscillates back and forth between contact with fountain roller 14 and distributor roller 16. Such oscillating ductor rollers are well known in the art. The function of both prior art oscillating ductor rollers and of the ductor roller 15 is to transfer ink from roller 14 to distributor roller 16.

In operation of the ink distribution assembly of FIG. 2, fountain means 11 spreads a film of ink on the outer cylindrical surface 22 as roller 14 rotates in the direction of arrow A. Roller 15 turns at the same speed as roller 14. Each time longitudinal strip 27 moves through the closest point of approach of rollers 14 and 15, strip 27 "kisses" surface 22 and receives ink therefrom. Each time strip 27 moves through the closest point of approach of rollers 15 and 16, strip 27 kisses and transfers ink to surface 26. Ink from surface 26 travels onto the outer cylindrical surfaces of form rollers 17 and 18 and from the outer cylindrical surfaces of form rollers 17 and 18 onto raised portions of the outer surface of plate 31. As plate 31 rotates, it transfers ink from the raised portions of plate 31 onto a strip 20 of paper or other material traveling intermediate rollers 19 and 12 in the directions of arrow D. The velocity of a point on surface 26 is greater than the velocity of strip 27. When strip 27 kisses surface 26, a one-way clutch assembly permits rollers 14 and 15 to freewheel and increase their speed of rotation such that the speed of movement of strip 27 is subsequently equivalent to the speed of movement of surface 26. As soon as strip 27 loses contact with roller 16, the speed of rotation of rollers 14 and 15 slows to the normal driven speed of rollers 14 and 15.

In FIG. 2, roller 56 of the cleaning apparatus is preferably, but not necessarily, formed from a soft rubber, and is provided with an outer sleeve or patches of Velcro (not shown) which engage ink--absorbent strip 57 and help force strip 57 intermediate rollers 56 and 29.

The frame for the ink distribution assembly of FIG. 2 is omitted for the sake of clarity. Fountain means 11 and rollers 14 to 19, 21, are, however, journalled for rotation in conventional fashion in a frame. Further, in the practice of the invention, the frame for ink distribution rollers 14 to 19, 21 is provided with a pair of spaced apart pins 63. The cleaning apparatus of FIG. 1 is mounted on the frame of the ink distribution assembly by placing each slot 54 and 55 over one of pins 63 in the manner illustrated in FIG. 2. In FIG. 2, the force of gravity, indicated by arrow M, causes the cleaning apparatus to pivot about pins 63 in the manner indicated by arrow P, and presses roller 56 against roller 17 in the manner indicated by arrow N.

In use of the cleaning apparatus of the invention, slots 54 and 55 are positioned on pins 63 in the manner illustrated in FIG. 2. The fountain means 11 is removed, or the ink is removed from the fountain means 11 and the ink distribution assembly is operated such that rollers 14 to 19 and 21 rotate. Motor 60 is operated to turn roller 56 at a speed in the range of about one to six rotations per minute, preferably about one rpm. The circumference of roller 56 is presently about eleven to twelve inches. Ink from roller 17 is collected on the portion of strip 57 intermediate rollers 56, 17. Further, any ink on rollers 14, 15 16 travels to roller 17 and onto strip 57. Similarly, any ink remaining on plate 31 or roller 18 tends to travel back to roller 17 and onto strip 57. Strip 57 moves from roller 45, over roller 56, and onto roller 50 in the directions of travel indicated by arrows J and K in FIG. 2. Roller 56 typically rotates at a slower speed than roller 17 so that the ink on roller 17 "wipes" onto strip 57. During cleaning by strip 57, the ink distribution apparatus of FIG. 2 ordinarily is operated so that roller 17 turns at about 150 rpm. The circumference of roller 17 is twelve inches. If the circumference of roller 17 is about eleven inches, the roller 17 preferably turns at about 175 rpm when contacted by roller 56. After a length of strip 57 equal to about one foot has passed intermediate rollers 17 and 56, all or most of the excess ink on rollers 14–18 has usually been removed from the ink distribution assembly.

In another embodiment of the invention, the cleaning apparatus of FIGS. 1 and 2 is utilized, but roller 45 is eliminated, and strip 57 is wound on roller 56 and travels from roller 56 to take up roller 50. The cleaning apparatus is still mounted on the ink distribution assembly in the manner illustrated in FIG. 2 and roller 56 still is pressed against roller 17 in the direction of arrow N by the force of gravity.

In still another embodiment of the invention, the cleaning apparatus of FIGS. 1 and 2 is utilized, but rollers 45 and 50 are eliminated and one or more layers of strip 57 are wound around roller 56 and a motor or other means is utilized to turn roller 56 at a desired rpm. The cleaning apparatus is still mounted on the ink distribution assembly in the manner illustrated in FIG. 2 and roller 56 is still pressed against roller 17 in the direction of arrow N by the force of gravity.

Cleaning fluid is preferably, but not necessarily, sprayed or otherwise applied to strip 57 before strip 57 passes intermediate rollers 56 and 17 to clean and wash ink from roller 17. The cleaning fluid can be sprayed on the strip 57 when it is wound around roller 45, be sprayed on strip 57 when it is intermediate rollers 45 and 56 and traveling in the direction of arrow J toward roller 56, or be applied to strip 57 in any other desired manner. In FIG. 1, strip 57 has been omitted for the sake of clarity.

Figure 3:
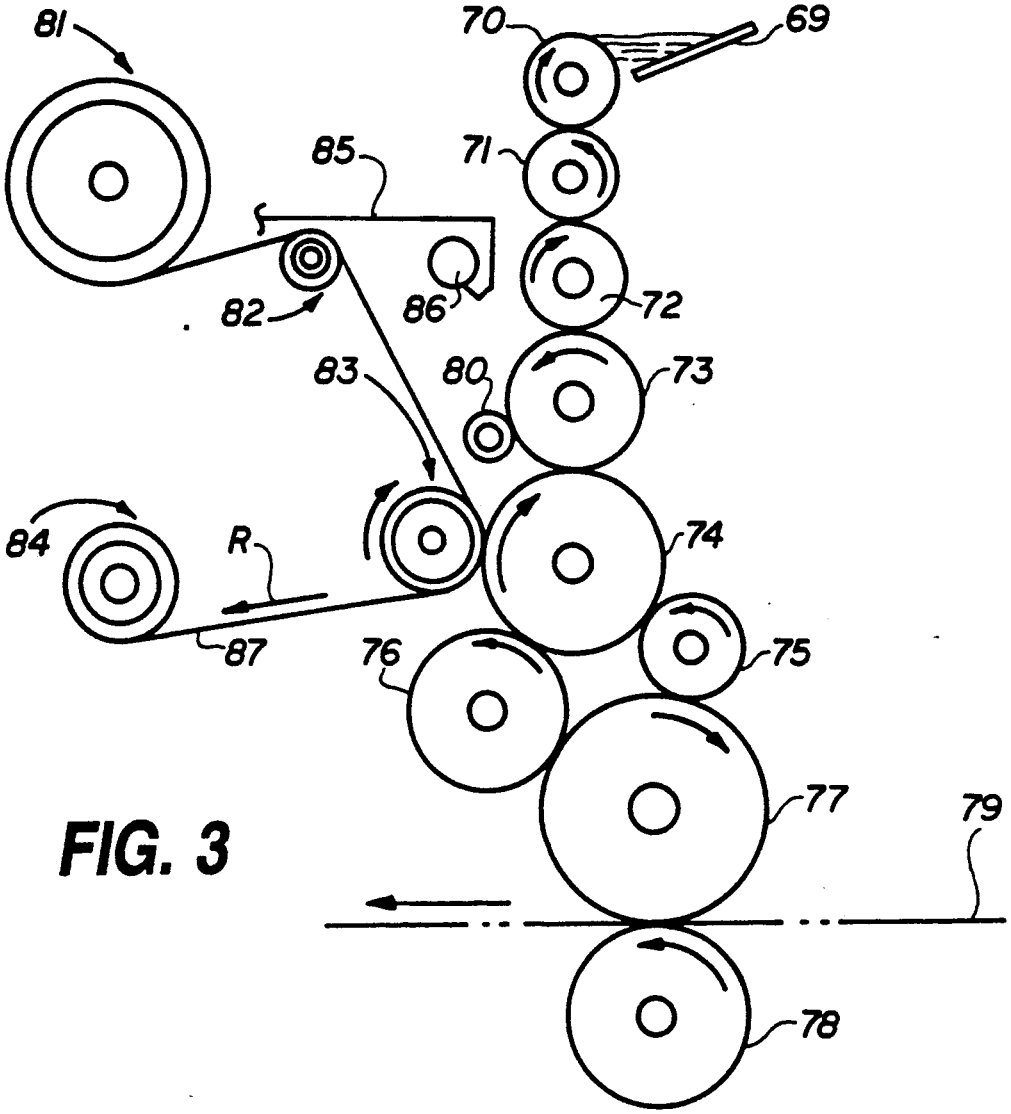

An alternate embodiment of the invention is illustrated in FIG. 3 and includes a wash up assembly including a roll 81 of ink absorbent or other wash up material, a guide roller 82, guide roller 83, and take up roller 84. The strip of material 87 from roller 81 is pulled by take up roller 84 over rollers 82 and 83 and from roller 83 to roller 84 in the direction of arrow R. Rollers 81 to 84 are rotabably mounted in a rigid frame which is similar to the frame shown for the wash up assembly in FIG. 1 and which includes at least one arm for pivotally removably mounting the rigid frame on the pin 86 of the rigid frame (not shown) which carries the ink distribution assembly including rollers 70 to 78, 80. The ink distribution assembly in FIG. 3 includes ink fountain 69, ink fountain roller 71, ink ductor roller 71, distributor rollers 72 and 73, vibrator or oscillator roller 74, form rollers 75 and 76, plate cylinder 77, impression cylinder 78, and rider roller 80. A strip of paper 79 is drawn between cylinders 77 and 78. In FIG. 3, the direction of travel of the outer cylindrical surface of roller 74 is opposite that of the outer cylindrical surface of roller 83 at the point at which roller 74 contacts strip 87. This opposing direction of travel of the surface or roller 74 is presently preferred, but not required, in the practice of the invention.

In addition to being applied directly to strip 57 (FIG. 2) or strip 87 (FIG. 3), cleaning fluid can also be sprayed on or otherwise applied to rollers in the ink distribution assembly.

Having described my invention in such terms as to enable those skilled in the art to understand and practice it, and having identified the presently preferred embodiments thereof, I claim:

1. In combination with an ink distribution assembly for printing apparatus, said assembly including frame means, a fountain roller mounted on said frame means, fountain means mounted on said frame means for storing a quantity of ink and distributing the ink on said fountain roller, a distributor roller mounted on said frame means and generally parallel to and at a fixed distance from said fountain roller, a ductor roller mounted on said frame means and generally parallel to said fountain roller for transferring ink from said fountain roller to said distributor roller, at least one downstream roller mounted on said frame means and parallel to and operatively associated with said distributor roller to carry ink from said distributor roller to a selected roller station in said printing apparatus, motive power means for causing said fountain roller, said ductor roller, said distributor roller and said downstream roller to rotate such that ink travels sequentially from said fountain means to said fountain roller, ductor roller, distributor roller, and downstream roller, said fountain roller, ductor roller, distributor roller, and downstream roller each turning about a horizontally oriented axis of rotation, the improvement comprising means for cleaning said ink distribution assembly, said cleaning means comprising (a) a portable frame;

(b) a cleaning roller mounted on said frame;

(c) attachment means for pivotally mounting said frame on said frame means of said ink distribution assembly such that (i) the force of gravity acting on said portable frame causes said portable frame to freely pivot about at least one pivot point on said frame means and displace said cleaning roller in a horizontally oriented direction of travel toward the axis of rotation of a selected one of the rollers in the group consisting of said fountain roller, ductor roller, distributor roller, and downstream roller, and (ii) said cleaning roller is beneath said pivot point; and, (d) means mounted on said frame for, when said attachment means is used to mount said frame on said frame means to displace said cleaning roller against said selected one of the rollers in said group, drawing a strip of material over said cleaning roller intermediate said cleaning roller and said selected one of the rollers in said group, said frame being shaped and dimensioned and said cleaning roller being mounted on said frame such that (i) the force of gravity causes said cleaning roller to press and maintain the portion of said strip of material intermediate said cleaning roller and said selected one of the rollers against said selected one of the rollers along a horizontally oriented contact line located on the cylindrical surface of said selected one of the rollers, positioned laterally from the axis of rotation about which said selected one of the rollers rotates, and positioned beneath said pivot point, (ii) points on the cylindrical surface of said selected one of the rollers located along said horizontally oriented line are traveling in a vertical direction generally normal to the ground.

2. In combination with an ink distribution assembly for printing apparatus, said assembly including:

frame means, a fountain roller mounted on said frame means, fountain means mounted on said frame means for storing a quantity of ink and distributing the ink on said fountain roller, a distributor roller mounted on said frame means and generally parallel to and at a fixed distance from said fountain roller, a ductor roller mounted on said frame means and generally parallel to said fountain roller for transferring ink from said fountain roller to said distributor roller, at least one downstream roller mounted on said frame means and parallel to and operatively associated with said distributor roller to carry ink from said distributor roller to a selected roller station in said printing apparatus, motive power means for causing said fountain roller, said ductor roller, said distributor roller and said downstream roller to rotate such that ink travels sequentially from said fountain means to said fountain roller, ductor roller, distributor roller, and downstream roller, said fountain roller, ductor roller, distributor roller, and downstream roller each turning about a horizontally oriented axis of rotation, the improvement comprising means for cleaning said ink distribution assembly, said cleaning means comprising (a) a frame;

(b) a cleaning roller mounted on said frame; and, (c) attachment means for pivotally mounting said frame on said frame means of said ink distribution assembly such that (i) the force of gravity acting on said cleaning means causes said frame to freely pivot about at least one pivot point on said frame means and displace said cleaning roller in a horizontally oriented direction of travel toward the axis of rotation of a selected one of the rollers in the group consisting of said fountain roller, ductor roller, distributor roller, and downstream roller, and (ii) said cleaning roller is beneath said pivot point, said frame being shaped and dimensioned and said cleaning roller being mounted on said frame such that (i) the force of gravity presses and maintains said cleaning roller against said selected one of the rollers along a horizontally oriented contact line located on the surface of said selected one of the rollers, positioned laterally from the axis of rotation about which said selected one of the rollers rotates, and positioned beneath said pivot point, and (ii) a vertical plane passing through the axis of rotation of said selected one of the rollers lies intermediate and is parallel to a first vertical plane passing through the axis of rotation of the cleaning roller and a second vertical plane passing through said pivot point.

3. An ink distribution assembly for printing apparatus, said assembly including (a) frame means;

(b) a fountain roller mounted on said frame means;

(c) fountain means mounted on said frame means for storing a quantity of ink and distributing the ink on said fountain roller;

(d) a ductor roller mounted on said frame means and generally parallel to and at a fixed distance from said fountain roller and (i) having an outer surface spaced apart from said fountain roller, and (ii) including a longitudinal resilient strip extending outwardly from said outer surface, said strip intermittently contacting said fountain roller to receive ink from said fountain roller;

(e) a distributor roller generally parallel to and at a fixed distance from said ductor roller means, said strip intermittently contacting said distributor roller to transfer ink from said strip to said distributor roller;

(f) at least one downstream roller mounted on said frame means and parallel to and operatively associated with said distributor roller to carry ink from said distributor roller to a selected roller station in said printing apparatus;

(g) motive power means for causing said fountain roller, said ductor roller, said distributor roller and said downstream roller to rotate such that ink travels sequentially from said fountain means to said fountain roller, ductor roller, distributor roller, and downstream roller, said fountain roller, ductor roller, distributor roller, and downstream roller each turning about a horizontally oriented axis of rotation;

(h) cleaning means including (i) a frame, (ii) a cleaning roller mounted on said frame, and, (iii) attachment means for pivotally mounting said frame on said frame means such that the force of gravity acting on said cleaning means causes said frame to freely pivot about at least one pivot point on said frame means and displace said cleaning roller in a horizontally oriented direction of travel toward the axis of rotation of a selected one of the rollers in the group consisting of said fountain roller, ductor roller, distributor roller, and downstream roller, and said cleaning roller is positioned beneath said pivot point, said frame being shaped and dimensioned and said cleaning roller being mounted on said frame such that the force of gravity presses and maintains said cleaning roller against said selected one of the rollers along a horizontally oriented contact line located on the cylindrical surface of said selected one of the rollers, positioned laterally from the axis of rotation about which said selected one of the rollers rotates, and positioned beneath said pivot point.

4. The combination of claim 2 wherein points on the cylindrical surface of said selected one of the rollers located along said horizontally oriented line are traveling in a vertical direction generally normal to the ground.

5. The combination of claim 1 wherein said vertical direction of travel is toward the ground.

6. The combination of claim 4 wherein said vertical direction is toward the ground.

* * * * *